US008066111B2

(12) United States Patent
Curley

(10) Patent No.: US 8,066,111 B2
(45) Date of Patent: Nov. 29, 2011

(54) GRIPPER CONVEYOR DELIVERY

(75) Inventor: Richard Daniel Curley, Dover, NH (US)

(73) Assignee: Goss International Americas, Inc., Durham, NH (US)

( * ) Notice: Subject to any disclaimer, the term of this patent is extended or adjusted under 35 U.S.C. 154(b) by 375 days.

(21) Appl. No.: 12/471,165

(22) Filed: May 22, 2009

(65) Prior Publication Data

US 2009/0288932 A1 Nov. 26, 2009

Related U.S. Application Data

(60) Provisional application No. 61/128,567, filed on May 22, 2008.

(51) Int. Cl.
*B65H 5/08* (2006.01)

(52) U.S. Cl. ..... 198/644; 270/52.26; 270/52.14; 270/52.19; 270/52.22

(58) Field of Classification Search ..... 198/644; 270/52.26–52.28, 52.14, 52.19, 52.22; 271/204–206, 271/69
See application file for complete search history.

(56) References Cited

U.S. PATENT DOCUMENTS

| | | | | | |
|---|---|---|---|---|---|
| 4,164,159 | A | | 8/1979 | Marciniak | 83/280 |
| 4,236,706 | A | * | 12/1980 | Schlough | 270/52.18 |
| 4,482,141 | A | | 11/1984 | Moser | 270/54 |
| 4,489,930 | A | * | 12/1984 | Meier | 270/52.3 |
| 4,518,156 | A | | 5/1985 | Moser | 270/54 |
| 4,555,101 | A | * | 11/1985 | Stobb | 271/12 |
| 4,743,005 | A | * | 5/1988 | Reist | 270/52.22 |
| 5,007,624 | A | * | 4/1991 | Chandhoke | 270/58.2 |
| 5,660,515 | A | | 8/1997 | Hartsoe | 412/1 |
| 5,740,900 | A | | 4/1998 | Cote et al. | 198/436 |
| 6,003,859 | A | * | 12/1999 | Reist | 271/204 |
| 6,213,280 | B1 | | 4/2001 | Abbadessa et al. | 198/377.02 |
| 6,612,559 | B2 | | 9/2003 | Boss | 270/52.18 |
| 7,192,027 | B2 | | 3/2007 | Schlough | 271/225 |
| 7,628,390 | B2 | * | 12/2009 | Stauber | 270/52.26 |
| 7,631,914 | B2 | * | 12/2009 | Curley | 294/106 |
| 2004/0239026 | A1 | * | 12/2004 | Nagai | 270/58.08 |
| 2005/0225023 | A1 | | 10/2005 | Schlough | 271/69 |
| 2007/0108687 | A1 | | 5/2007 | Doucet | 270/52.26 |

* cited by examiner

*Primary Examiner* — Mark A Deuble

(74) *Attorney, Agent, or Firm* — Davidson, Davidson & Kappel, LLC

(57) ABSTRACT

A signature transport device is provided. The signature transport device includes a saddle conveyor for transporting signatures, an escalator tucker for lifting the signatures off the saddle conveyor and a linear gripper conveyor located adjacent to the escalator tucker and having a plurality of grippers for gripping the signatures. The linear gripper conveyor has a velocity component that is equal to or greater than a velocity component of the escalator tucker when the signatures are gripped from the escalator tucker. A method for transporting signatures is also provided.

20 Claims, 5 Drawing Sheets

GRIPPER CONVEYOR DELIVERY

This claims the benefit of U.S. Provisional Application No. 61/128,567 filed on May 22, 2008, and hereby incorporated by reference herein.

BACKGROUND

The present invention relates generally to printing presses and more particularly to grippers and saddle binders.

U.S. Pat. No. 4,482,141 discloses a method and device for conveying signatures from a blade chain conveyor supporting the signatures directly at a fold line. The signatures are gripped from above by orbitally-rotating clamping pads, which then transfer the signatures to a belt conveyor perpendicular to the blade chain conveyor.

U.S. Pat. No. 5,740,900, hereby incorporated by reference herein, discloses an apparatus for splitting an initial product stream comprising a single conveying belt having a plurality of grippers traveling along a single conveyor path. At least one of the grippers is capable of rotating a held product from one side of the belt to the other side, so as to create a secondary product stream.

U.S. Pat. No. 6,213,280, hereby incorporated by reference herein, discloses a compact gripper having both a high gripper force and a large gripper jaw travel. The gripper includes stationary gripper member and a movably mounted gripper member being relatively movable toward said stationary gripper member.

U.S. Pat. No. 6,612,559 discloses a conveying device in which printed products are safely guided in the area of the intermediate conveying device and which makes it possible to connect two chain conveyors such that they have different conveying directions. Printed products are no longer pushed by followers between two chain conveyors but are gripped and guided by grippers and in this way transported from the first chain conveyor to the second chain conveyor.

U.S. Pat. No. 7,192,027, hereby incorporated by reference herein, discloses a device permitting removal of signatures from a saddle conveyor. A signature transport device includes a first conveyor for moving a plurality of folded signatures in a first direction, and a second conveyor including a first blade having a first edge parallel to the first direction for lifting a first signature of the plurality of signatures from the first conveyor.

BRIEF SUMMARY OF THE INVENTION

In the prior art, differences in velocity from one device to the next may result in sudden loads being applied to a printed product or signature during transfer of the products or signatures. These loads may damage the products and signatures.

Multiple transfer mechanisms, for example, belts and grippers, are sensitive, require proper timing and setup and are likely to jam. The grippers require high clamping forces to grip a product or signature. The transfer mechanisms have limited machine configuration flexibility, and it is difficult to compensate for varying thickness in products or signatures.

An object of the present invention is to provide efficient transfer of signatures from a saddle conveyor and escalator tucker to a gripper conveyor.

The present invention provides a signature transport device including a saddle conveyor for transporting signatures, an escalator tucker for lifting the signatures off the saddle conveyor and a linear gripper conveyor located adjacent to the escalator tucker and having a plurality of grippers for gripping the signatures. A velocity component of the linear gripper conveyor is equal to or greater than a velocity component of the escalator tucker when the signatures are gripped from the escalator tucker.

In addition, at least one gripper may rotate on the gripper conveyor to change the orientation of the signature being gripped.

The present invention further provides a method for transporting signatures including the steps of conveying signatures in a first direction on a saddle conveyor, lifting signatures off the saddle conveyor in a second direction using an escalator tucker, gripping signatures from the escalator tucker with grippers mounted on a linear gripper conveyor so a velocity component of the signatures remains at least constant and transporting the signatures in at least a third direction.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Figure 1:
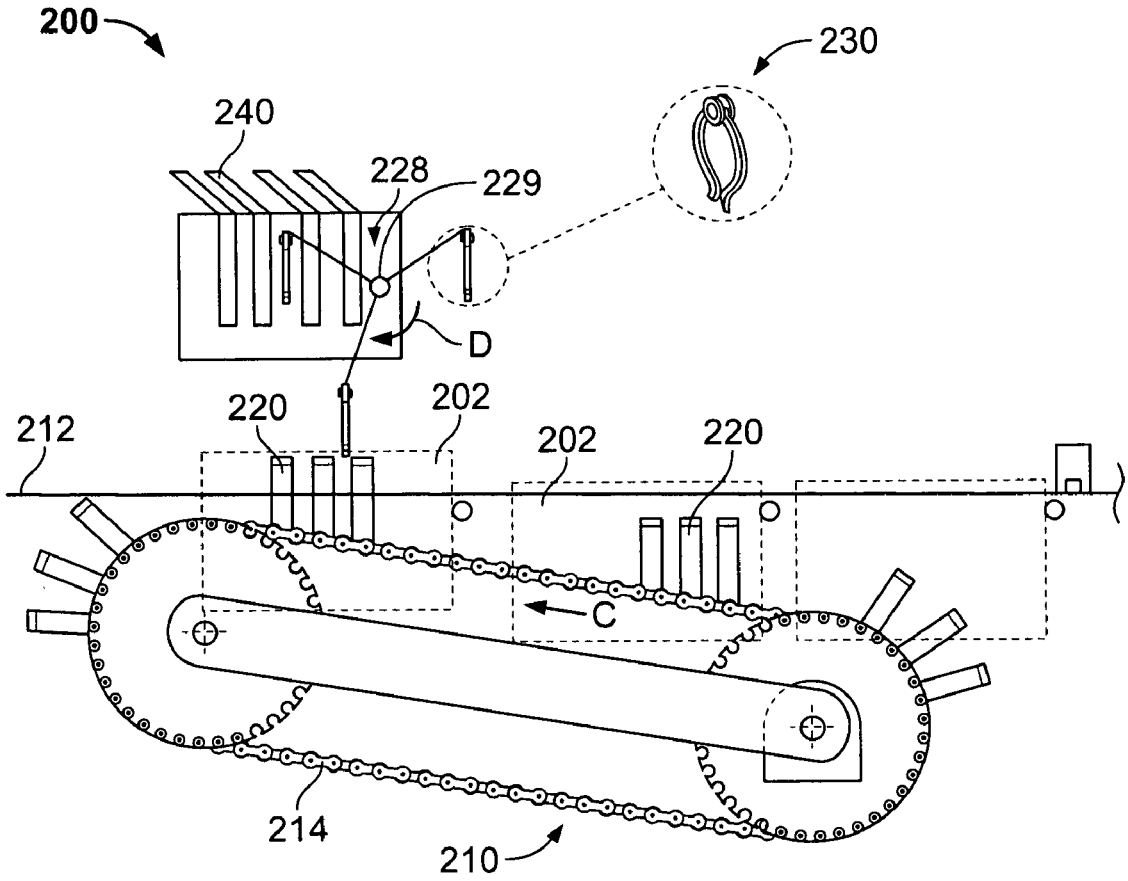
FIG. 1 (Prior Art)
FIG. 1 shows a signature transport device known in the prior art.

FIG. 1 shows a signature transport device 200 known in the prior art. Transport device 200 includes a saddle raceway 212 and a signature lifting device 210. Signatures 202 are conveyed on top of saddle raceway 212. Signature lifting device 210 includes blades 220 which extend through a gap in raceway 212 to lift signatures up. A chain 214 and blades 220 rotate in a direction C around drive sprockets which slopes upward. Signatures 202 are lifted by blades 220 away from raceway 212. Signatures 202 are then gripped by a rotary gripper device 228 and removed from lifting device 210. Rotary gripper device 228 includes three grippers 230 at the end of three arms that rotate around axis 229 in the direction of arrow D. Grippers 230 are configured to clamp down on exterior sides of the signature and lift the signature from blades 220. The gripper device 228 and grippers 230 rotate at a constant rotational speed. The rotational speed of each gripper 30 may be selected so that a tangential component of the speed in the C-direction matches the blade speed in the C-direction, but may also be somewhat faster. Signatures 202 are transferred from grippers 230 to belt conveyor 240 for further transport downstream. Grippers 230 grip signatures from above, then tuck signatures 202 into a series of belts forming belt conveyor 240. Signatures 202 are further transported perpendicular to the saddle raceway 212 by belt conveyor 240.

The prior art requires multiple transfers of signatures from saddle raceway 212, signature lifting device 210, grippers 230 and belt conveyor 240. The changes in direction and speed during the transfers apply loads and pressure to the signatures which may result in damage. By advantageously providing a matched velocity gripper conveyor chain, clamping forces required to control signatures may be reduced. Signatures may be transported at high speeds from a gripper transport chain directly to an infeed, a drop station or downstream device, for example, a trimmer or a saddle binder. By reducing the number of transfers and providing a smoother transfer from the escalator tucker to the gripper conveyor chain, machine efficiency is improved.

Figure 2:
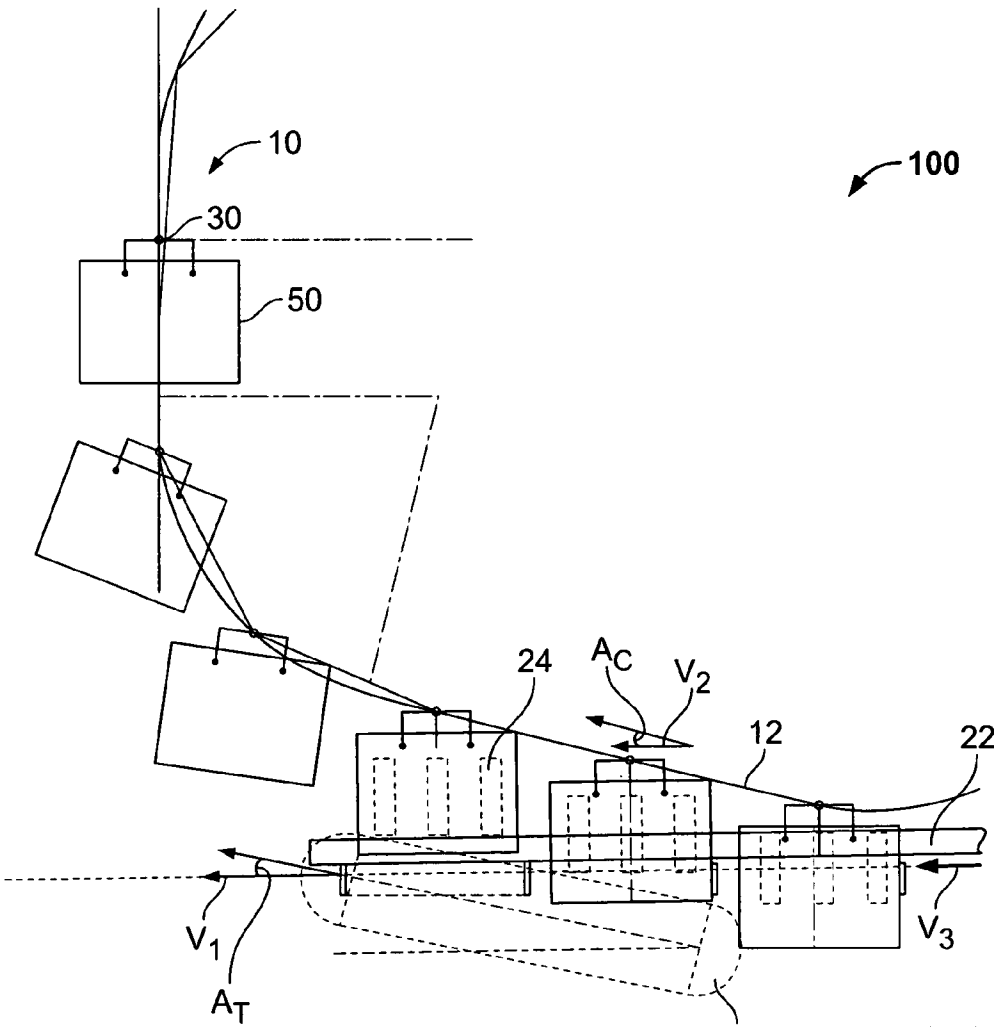
FIG. 2 shows a schematic view of a gripper conveyor according to the present invention.

FIG. 2 shows a preferred embodiment of a linear gripper conveyor 10 according to the present invention. A signature transport device 100 in accordance with the present invention includes a saddle conveyor 22 conveying signatures on a saddle raceway, an escalator tucker 20 for lifting signatures up and off of the saddle raceway and a linear gripper conveyor chain 10. Signature transport device 100 transports signatures 50 from escalator tucker 20 directly downstream to, for example, a trimmer, via gripper conveyor 10. Gripper conveyor 10 includes a plurality of rotating grippers 30 on a gripper chain 12 which transport signatures 50. The saddle conveyor and escalator tucker may be similar to those disclosed in U.S. Pat. No. 7,192,027 and U.S. Publication No. 2007/0108687, hereby incorporated by reference herein.

Raceway 22 is arranged horizontally and conveys signatures 50 in a substantially horizontal direction. Escalator tucker 20 is arranged at an angle $A_T$ with respect to raceway 22 and the horizontal direction. A segment of gripper conveyor 10 is also arranged at an angle $A_C$ with respect to raceway 22 and the horizontal direction over a segment when grippers 30 are gripping signatures 50 off of escalator tucker 20. Angles $A_T$ and $A_C$ may be 15° or less. Angles $A_T$ and $A_C$ are preferably substantially similar or identical to provide a smooth transition for signatures 50. When angle $A_C$ equals angle $A_T$ gripper conveyor chain 12 and escalator tucker 20 are parallel to each other across the length required for transfer to grippers 30. When angles $A_T$ and $A_C$ are substantially similar or identical the loads and pressure applied to signatures 50 during transfer from escalator tucker 20 to gripper conveyor 10 are reduced.

Saddle conveyor 22 travels at a velocity $V_3$, escalator tucker 20 travels at a velocity $V_1$ and gripper chain conveyor 12 travels at a velocity $V_2$. A horizontal velocity component $V_3$ of saddle conveyor 22 is matched to a horizontal velocity component $V_1$ of escalator tucker 20. The velocities $V_1$,$V_3$ are matched to minimize the disturbance of signatures 50 as signatures 50 are lifted off saddle conveyor 22. Thus in the direction of travel, the horizontal velocity of signatures 50 is not slowed during transfer from raceway 22 to blades of escalator tucker 20.

In order to continue the smooth transfer, a horizontal velocity component $V_2$ of gripper chain 12 may be matched to or greater than the horizontal velocity component $V_1$ of escalator tucker 20. In the direction of travel, the horizontal velocity of signatures 50 is not slowed during transfer from blades of escalator tucker 20 to gripper conveyor 10. If horizontal velocity $V_2$ is greater than $V_1$, the minimum length needed for gripper 30 to grip signatures 50 and remove signatures 50 from escalator tucker 20 is reduced.

After signatures are removed from escalator tucker 20, grippers 30 move away from saddle conveyor 22 and may change the orientation of signature 50 as desired during transport. As shown by a sequence of signatures 50, 51, 52, 53, and 54, grippers 30 are able to rotate signatures 50 from a gripping position, signature 50, to a desired position, signature 54, while transporting signatures 50, 51, 52, 53, 54 on gripper conveyor 10. Rotating grippers 30 may reorient signatures 50 for delivery at any angle or in any position desired. Thus, signatures 50 can be delivered in any orientation needed as opposed to standard known deliveries which present signatures in one position, typically perpendicular to saddle conveyor 22.

Gripper conveyor 10 includes flexible setup and delivery options. The geometry of linear gripper conveyor chain 12 may be arranged and adjusted in a variety of configurations to change delivery options or delivery characteristics, including, for example, pitch, velocity, angle, signature orientation and signature positioning. The geometry of linear gripper conveyor chain 12 may vary throughout the length of chain 12 and may be straight, angular, circular, arced, curved or any combination thereof. Chain 12 is preferably an endless chain. Providing a linear gripper chain 12 having a length that can transport signatures throughout a press facility is advantageous over the known rotating gripper arms in the prior art which are limited in their ability to move and transport signatures. Rotating grippers rotate about a point or axis (229 in FIG. 1) but cannot transport signatures over any length or distance, for example, the distance to a trimmer. Another advantage of the linear gripper chain 12 includes being able to easily change or modify the downstream path of signatures 50 as desired by adjusting the chain configuration.

Figure 3:
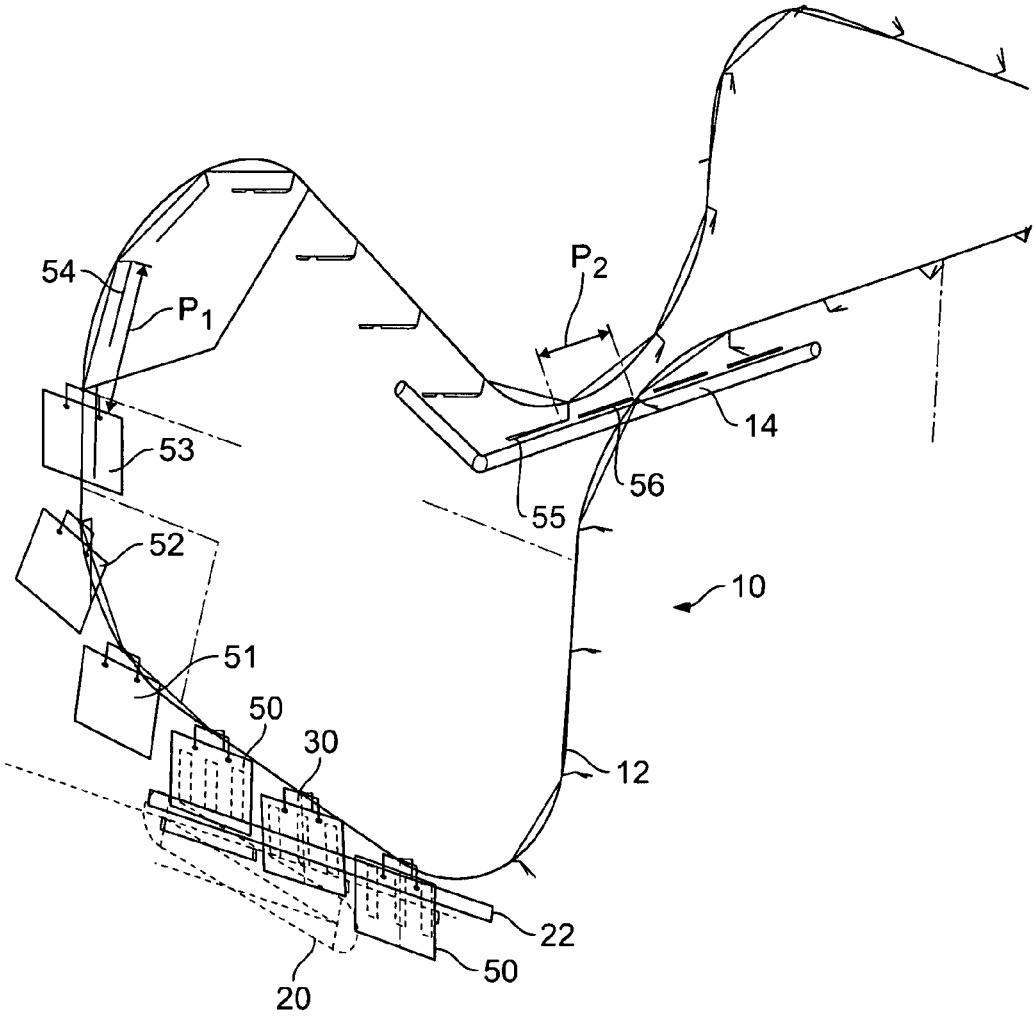
FIG. 3 shows a schematic side view of the embodiment of FIG. 2.

Gripper conveyor 10 may be setup to transport signatures to a trimmer, a drop station or another infeed downstream. For example, as shown in FIG. 3, signature 50 may be rejected at a conventional gripper conveyor drop station, a generic infeed 14. The pitch of signatures 50 may be changed by changing the geometry of conveyor chain 12, for example, by curving chain 12 as shown in FIG. 2. The pitch $P_2$ between signature 56 and signature 55 is less than a pitch $P_1$ between signature 54 and signature 53. In addition, the velocity of signatures 50 may be changed. For example, the velocity of signature 50 may be slowed by curving gripper chain 12 into infeed 14. Varieties of configurations are possible after gripper 30 carries signature 50 away from the saddle conveyor 22.

By eliminating the need for subsequent belt transfers, flexibility is increased with respect to delivery and accommodating different types of signatures. Grippers 30 can accommodate for changes in thickness in signatures without having to adjust additional belt or tape conveyors.

FIG. 3 shows rotatable gripper 30. Gripper 30 may be similar to the gripper disclosed in U.S. Pat. No. 5,740,900. Gripper 30 has a rotational axis Y about which gripper head 37 is pivotable. Gripper 30 moves in a direction X along gripper chain 12. The rotational axis Y extends perpendicular to the conveying direction X, allowing gripper head 37 to rotate. Gripper 30 has a pin 31 linked to a moveable part 36. A stationary part 35 is mounted onto a support 34. By applying pressure to pin 31, moveable portion 36 moves downward releasing a signature held between stationary part 35 and moveable part 36.

On support 34 a tensioning device 33 is mounted. A second pin 32 is provided for rotating gripper head 37 about axis Y. In a first position, spring 33 is held in tension by an actuation device. When the second pin 32 is pressed, the actuating mechanism releases spring 33 from tension and the gripper head 37 rotates counterclockwise around rotatable axis Y.

Figure 4:
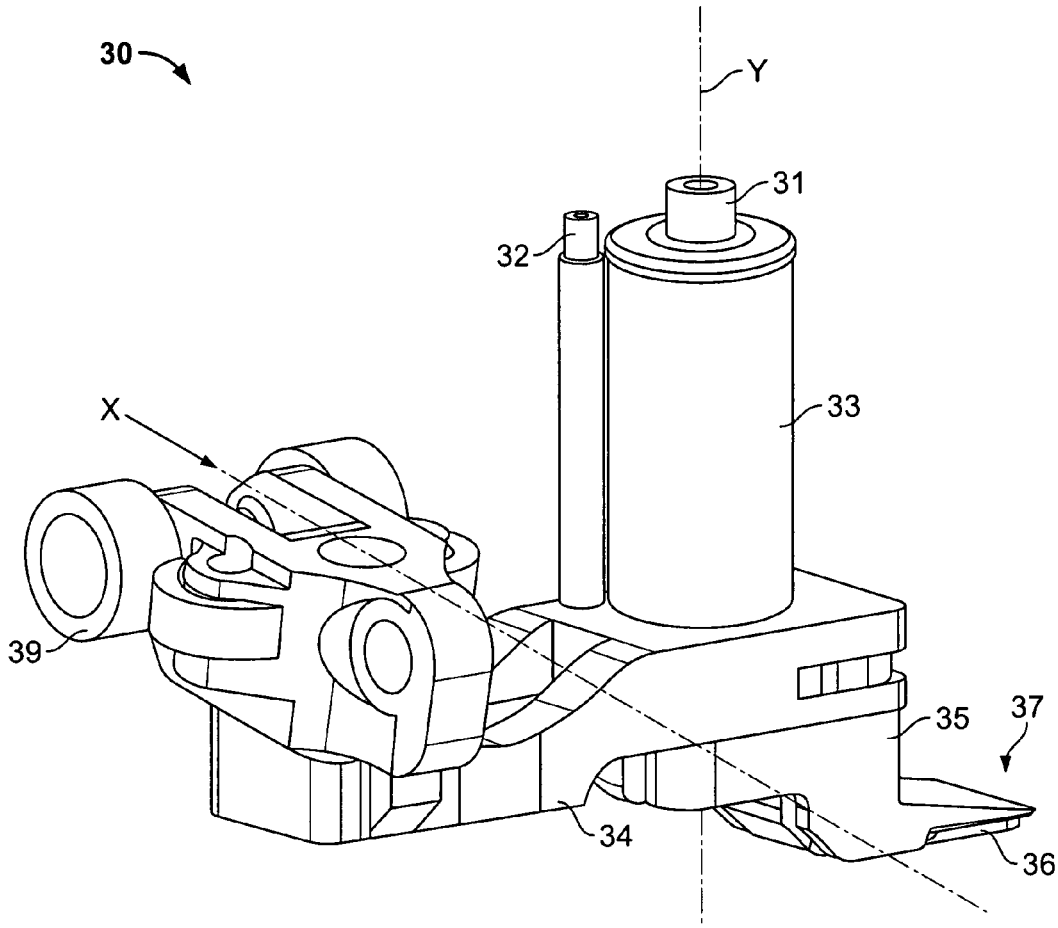
FIG. 4 (Prior Art)
FIG. 4 shows a first embodiment of a gripper of the gripper conveyor shown in FIG. 2.
Figure 5:
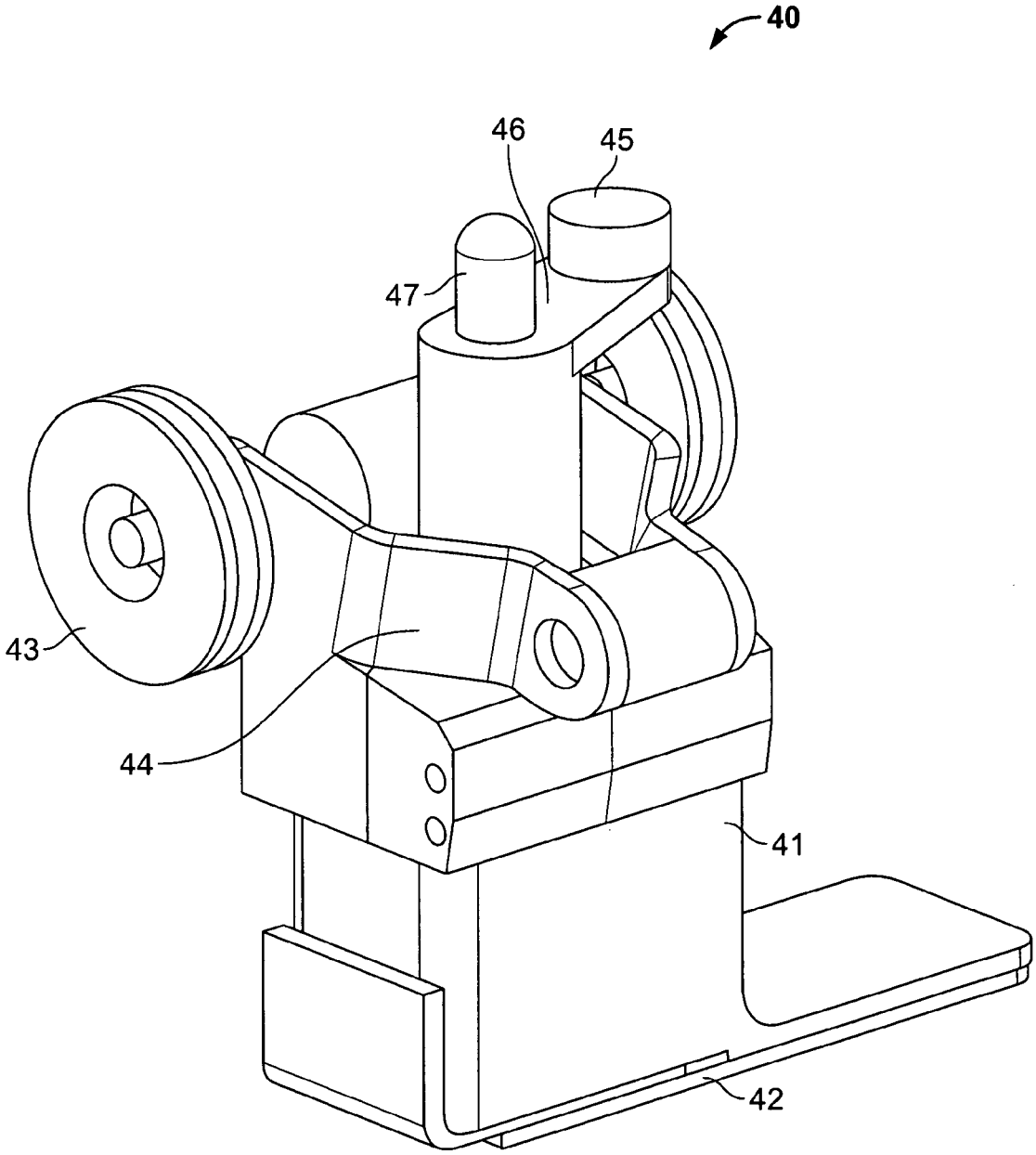
FIG. 5 (Prior Art)
FIG. 5 shows a second embodiment of a gripper of the gripper conveyor shown in FIG. 2.

FIG. 4 shows a rotatable gripper 40. Gripper 40 may be similar to the gripper disclosed in U.S. Pat. No. 6,213,280. Gripper 40 includes a stationary part 41 and a moveable part 42. Rollers 43 are arranged on a support 44. An actuating pad 45 is fastened to a rotating lever 46. The stationary part 41 may be rotated via lever 46 with respect to the conveying direction. An actuating element 47 is provided to move moveable part 42 with respect to stationary part 41. By actuating rotating lever 46, gripper 40 may be rotated with respect to the conveying direction.

Both grippers 30 and 40, individually or in combination, may be provided on gripper chain 12. In addition, gripper conveyor 10 may include any suitable gripper mounted on gripper chain 12. Gripper conveyor 10 may also include any number of grippers 30 on chain 12, for example, 10 or more. The number of grippers 30 included may depend upon the length of gripper conveyor chain 12 and the size of signatures being gripped. Spacing of grippers 30 on gripper chain 12 may be varied as desired, for example, to accommodate larger or smaller signatures. The velocity of gripper conveyor 10 may also be adjusted to accommodate the velocity of escalator tucker 20 as desired.

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A signature transport device comprising:

a saddle conveyor for transporting signatures;

an escalator tucker for lifting the signatures off the saddle conveyor; and a linear gripper conveyor located adjacent to the escalator tucker and having a plurality of grippers for gripping the signatures;

the linear gripper conveyor having a velocity component that is equal to or greater than a velocity component of the escalator tucker when the signatures are gripped from the escalator tucker.

2. The signature transport device as recited in claim 1 wherein the velocity of the gripper conveyor is greater than the velocity of the escalator tucker.

3. The signature transport device as recited in claim 1 wherein the velocity component of the linear gripper conveyor is a horizontal velocity component and the velocity component of the escalator tucker is a horizontal velocity component.

4. The signature transport device as recited in claim 1 wherein the linear gripper conveyor includes at least ten grippers.

5. The signature transport device as recited in claim 1 wherein at least one gripper rotates to change the orientation of a signature being gripped.

6. The signature transport device as recited in claim 5 wherein the signature is rotated 90 degrees.

7. The signature transport device as recited in claim 1 wherein the escalator tucker is inclined with respect to the saddle conveyor and a segment of linear gripper conveyor is inclined with respect to the saddle conveyor.

8. The signature transport device as recited in claim 7 wherein the escalator tucker and the segment of the linear gripper conveyor are inclined at a same angle.

9. The signature transport device as recited in claim 7 wherein the escalator tucker and linear gripper conveyor are parallel to each other when the gripper is gripping a signature lifted by the escalator tucker.

10. The signature transport device as recited in claim 7 wherein the escalator tucker and linear gripper conveyor are inclined at most by an angle of 15°.

11. The signature transport device as recited in claim 1 wherein the linear gripper conveyor includes a reconfigurable geometry.

12. The signature transport device as recited in claim 11 wherein the linear gripper conveyor is configured to deliver signatures at a desired pitch.

13. The signature transport device as recited in claim 11 wherein the linear gripper conveyor is configured to deliver signatures having a velocity different from the velocity of the signatures during gripping from the escalator tucker.

14. The signature transport device as recited in claim 11 wherein the linear gripper conveyor is configured to deliver signatures at a desired angle.

15. The signature transport device as recited in claim 1 wherein the linear gripper conveyor directly delivers signatures to a trimmer, a drop off station or an infeed downstream from the escalator tucker.

16. A method for transporting signatures comprising the steps of:

conveying signatures in a first direction on a saddle conveyor;

lifting signatures off the saddle conveyor in a second direction using an escalator tucker;

gripping signatures from the escalator tucker with grippers mounted on a linear gripper conveyor so a velocity component of the signatures remains at least constant; and transporting the signatures in at least a third direction.

17. The method as recited in claim 16 further comprising the step of rotating the signatures on the linear gripper conveyor.

18. The method as recited in claim 16 further comprising the step of delivering the signatures to a trimmer, drop off station or an infeed directly.

19. The method as recited in claim 16 further comprising the step of changing the pitch or velocity of the signatures downstream from the escalator tucker.

20. The method as recited in claim 16 further comprising the step of configuring a geometry of the linear gripper conveyor to change delivery options or delivery characteristics.

* * * * *